US005453915A

United States Patent [19]

Bradley, III

[11] Patent Number: 5,453,915

[45] Date of Patent: Sep. 26, 1995

[54] LIGHTED ADJUSTABLE MIRROR WITH CLAMP

[76] Inventor: Raymond L. Bradley, III, 137 Evergreen Ave., Brentwood, N.Y. 11717

[21] Appl. No.: 254,696

[22] Filed: Jun. 6, 1994

[51] Int. Cl.[6] ..... A45D 42/10; F21V 33/00

[52] U.S. Cl. ..... 362/144; 362/135; 362/142; 362/200; 362/275; 362/396; 362/426; 248/474; 248/487

[58] Field of Search ..... 362/135, 138, 362/139, 142, 144, 396, 426, 249, 250, 200, 275; 248/487, 474, 126, 231.8; 132/288

[56] References Cited

U.S. PATENT DOCUMENTS

| | | | |
|---|---|---|---|
| 1,105,039 | 7/1914 | Olbon | 248/126 |
| 2,943,184 | 6/1960 | Christopherson | 362/139 |
| 4,745,528 | 5/1988 | Dieterle | 362/135 |

FOREIGN PATENT DOCUMENTS

| | | | |
|---|---|---|---|
| 224804 | 11/1924 | United Kingdom | 362/142 |
| 1043770 | 9/1966 | United Kingdom | 248/474 |

*Primary Examiner*—Ira S. Lazarus
*Assistant Examiner*—L. Heyman
*Attorney, Agent, or Firm*—Peter Loffler

[57] ABSTRACT

A lighted adjustable mirror with clamp is disclosed. The device consists of a illuminated two-surfaced mirror—one surface without magnification, the other surface with magnification. The mirror, housed within a frame, is pivitolly attached to a bracket. The bracket is pivitolly attached to a flexible column. The mirror is free to pivot about mutually perpendicular axes with the column adding further multi-directional adjustment. The column is attached to a clamp for easy securement to a variety of surfaces.

4 Claims, 1 Drawing Sheet

LIGHTED ADJUSTABLE MIRROR WITH CLAMP

BACKGROUND OF THE INVENTION

1. Field of the Invention

The present invention relates to lighted adjustable mirrors with attachment clamp.

2. Background of the Prior Art

Mirrors are very useful and handy tools. One only has to look about to see their prevalence in society. Life would be different indeed if we did not have mirrors.

One type of mirror that has proven very successful, is the small grooming mirror. These mirrors, typically hand-held, prove invaluable for grooming purposes. By being held in one hand, a person can adjust his or her hair with the other. In an automobile, a person can use such a mirror without sacrificing the driver's use of the rearview mirror. Such mirrors have also found use in certain medical self-checks.

Although a simple hand-held mirror is a great tool in and of itself, many desirable features can be added to such a tool to greatly enhance its utility. First the mirror should have two surfaces. The first surface of the mirror can be without magnification for normal use. The second surface can have increased magnification so that the user can have a close look at a relatively small area of his or her body.

A second additional feature useful to a small grooming mirror is that it can be secured to a surface such as a counter top, interior surface of a car or the like. By securing the mirror rigidly in place, a person is free to use both hands for grooming. Ideally, such a securement feature should be relatively simple and quick to use.

To complement the second feature described above, a small grooming mirror should be positionally adjustable. Toward this end, the mirror should be pivotal on both its horizontal and vertical axis. Additionally, the column of the mirror should be flexible to provide increased adjustment capability.

A final feature useful to a small grooming mirror is illumination means. Such illumination will permit the mirror to be used in low light and no light situations.

The addition of the above-described features to a simple grooming mirror will produce a tool of exceptional utility and desire. However, the art has, thus far, failed to produce such a combined tool. Although mirrors beyond the simple hand-held configuration have been disclosed, no tool gives the complete functionality as described above.

In British patent 1,043.770 issued to Borowski, a two-sided mirror is disclosed. The mirror rotates about on two mutually perpendicular axes and has an adjustable column. The Borowski patent is designed to be placed on the floor or similar surface and would be very awkward to use in hand-held adaptation. Furthermore, the device lacks a simple clamp means for secure attachment of the device to a surface. Finally, the device lacks illumination means, rendering the mirror useless in dimly lit situations.

U.S. Pat. No. 1,105,039 issued to Olbon discloses a mirror having clamp means to secure the mirror to a surface. However, the Olbon clamp requires the rotation of a thumb screw in order to tighten the clamp means onto the surface of attachment. As such, quick attachment and detachment of the device cannot be attained. Furthermore, the clamp of the Olbon invention fails to provide means to protect delicate surfaces onto which the device may be clamped. Finally the Olbon device, like the Borowski device, is ill configured for use as a hand-held mirror.

U.S. Pat. No. 4,735,528 issued to Dieterle discloses a lighted hand-held mirror. Although this feature is desirable, the Dieterle fails to teach any other of the desirable features associated with hand-held mirrors.

What is needed is a hand-held mirror that has two oppositely disposed mirror surfaces—one surface without magnification, the other surface with magnification—with both surfaces being illuminated. Such a mirror must be able to be adjustable about is horizontal and vertical axes and should have a flexible column for additional position adjustment. This mirror should provide clamp means that make the mirror attachable to a variety of surfaces. The clamp means should not damage delicate surfaces.

SUMMARY OF THE INVENTION

The present invention provides a grooming-type mirror that meets the above-described needs. The device consists of a two-sided mirror. One side of the mirror has no magnification while the other side of the mirror has magnification. Each side has illumination means to provide light for the user.

The mirror is pivotally held within a mirror support bracket. By being so held, the mirror is rotatable about its horizontal axis.

The mirror support bracket is pivotally attached to a flexible column. By being so attached, the mirror is rotatable about its vertical axis. As the flexible column is flexible, additional mirror adjustments can be achieved.

Located at the bottom of the column is a clamp. The clamp is a clothespin-type clamp. This type of clamp permits easy attachment of the device to and detachment from a selected surface. The inner surfaces of the jaws have rubber pads located thereon, so that if the device is attached to a delicate surface the clamp will not damage the surface.

The lighted adjustable mirror with clamp of the present invention provides a very useful and practical tool. It has a normal surface as well as a magnified surface for a close-up look. Each surface is illuminated for better viewing in all lighting conditions. It is adjustable about two mutually perpendicular axes and has additional adjustment means to raise, lower, or shift the mirror from side to side. The mirror of the present invention can be quickly clamped to and declamped from many surfaces including delicate surfaces.

Therefore, it is an object of the present invention to provide a lighted adjustable mirror with clamp that provides two mirror surfaces, one surface providing a normal view, the other surface providing a magnified view.

It is another object of the present invention to provide a lighted adjustable mirror with clamp that provides multi-directional adjustment of the mirror.

It is another object of the present invention to provide a lighted adjustable mirror with clamp that provides the ability to quickly secure the mirror to a surface without damaging the surface.

It is a final object of the present invention to provide a lighted adjustable mirror with clamp that is simple to use and relatively inexpensive to manufacture.

BRIEF DESCRIPTION OF THE DRAWINGS

Similar reference numerals refer to similar parts throughout the views of the drawings.

DETAILED DESCRIPTION OF THE PREFERRED EMBODIMENT

Figure 2:
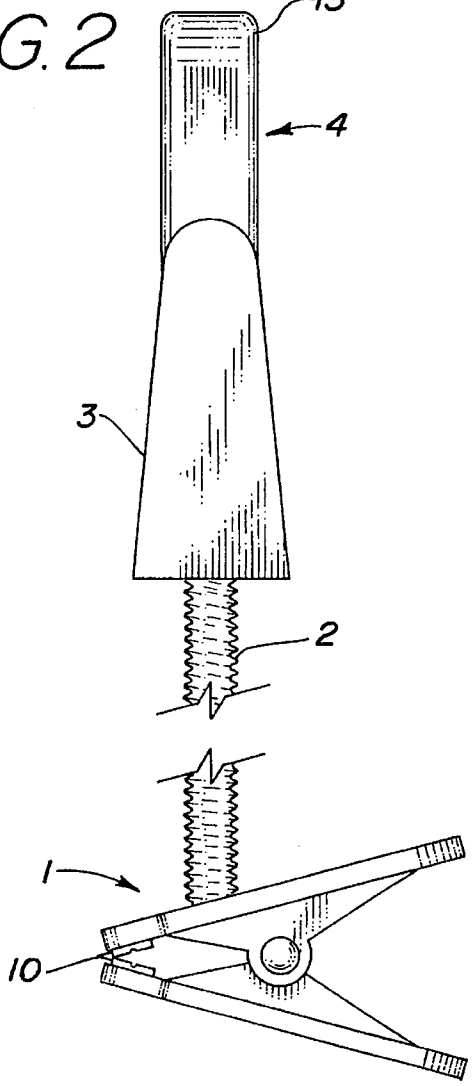
FIG. 2 is a side elevation view of the lighted adjustable mirror with clamp of the present invention.
Figure 1:
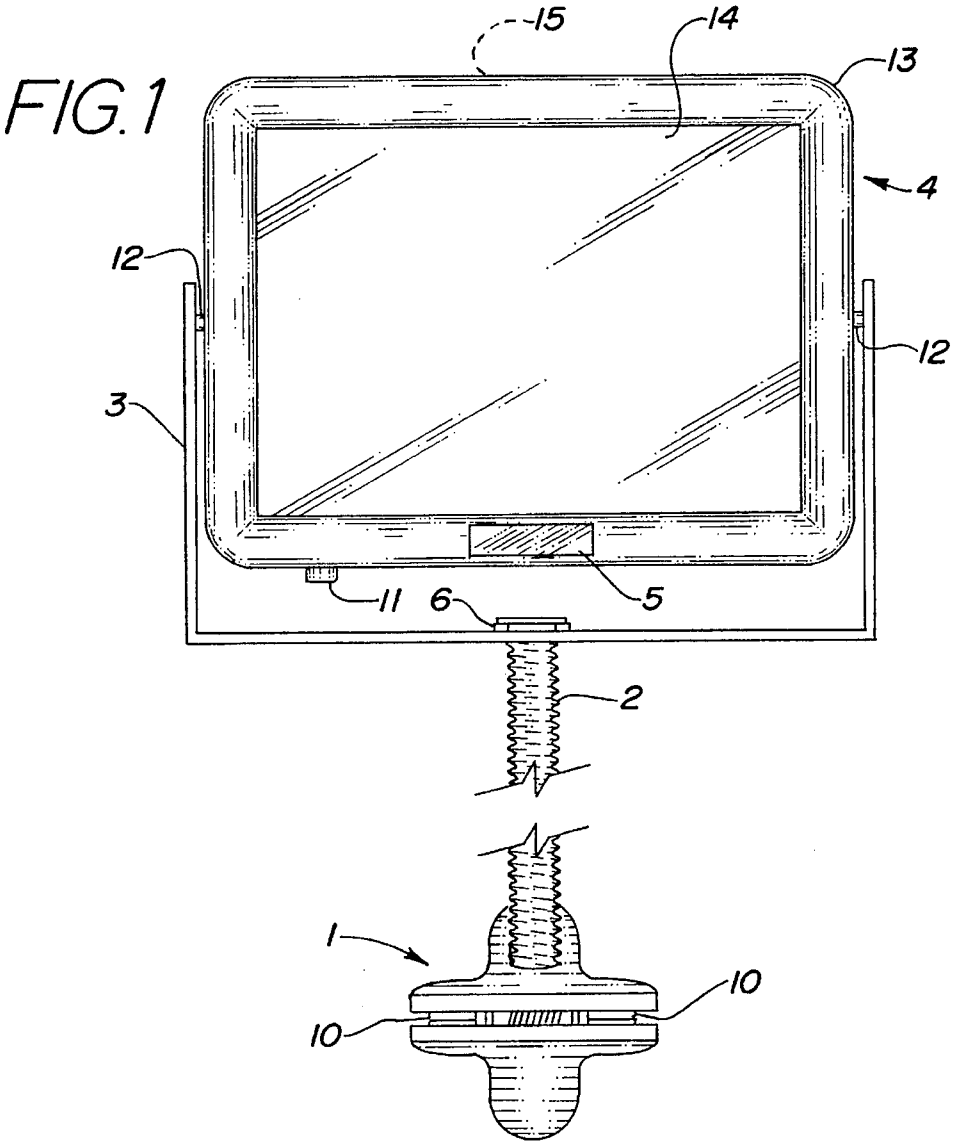
FIG. 1 is a perspective view of the lighted adjustable mirror with clamp of the present invention.

FIG. 1 illustrates the lighted adjustable mirror with clamp of the present invention. The device consists of a bracket 3. The bracket is U-shaped. A mirror assembly 4 is pivotally attached to bracket 3 at points 12. The mirror assembly 4 is in corresponding shape to the bracket 3. By being pivotally attached to bracket 3, the mirror assembly 4 is free to rotate about it horizontal axis. Although the bracket 3 and the mirror assembly 4 are illustrated in rectangular configuration, it will be understood by those skilled in the art that the use of a circular or oval configured bracket and mirror assembly will function identically to the disclosed embodiment of the present invention.

The mirror assembly 4 consists of a frame 13, a first mirror surface 14 and a second mirror surface 15. The first mirror surface 14 is a normal mirror surface providing no magnification. The second mirror surface 15 provides magnification of a predetermined intensity.

Located on the frame is a light 5. The light 5 provides illumination for the user of the mirror. The light is powered by a common battery (not shown) and is turned on and off by a push button switch 11 located on the frame. One light 5 is provided for the first mirror surface 14 and a second light 5 is provided for the second mirror surface 15.

The bottom of the bracket 3 is pivitolly attached to a column 2. A fastener 6 holds the bracket 3 to the column. By being pivitolly attached to the column 2, the bracket 3 is free to rotate about its vertical axis.

The column 2 is flexible. By being flexible, the bracket 3 and mirror assembly 4 can be shifted left or right, up or down. Once so shifted, the bracket 3 and mirror assembly will maintain their position until altered.

The bottom of the column 2 is attached to a clamp 1. The clamp 1 is a spring-loaded clothespin-type of clamp. This clamp 1 permits the device to be attached to a variety of surfaces such as a counter, car visor, chair back, etc. To attach the device to a selected surface, simply squeeze the ends of the clamp 1 in order to open the jaws. Straddle the attachment surface with the jaws and release the ends. The device will be securely attached to the surface. To detach the device from the surface, simply squeeze the ends of the clamp 1 and pull away from the surface.

Attached to the inner surfaces of the jaws are rubber pads 10. These rubber pads 10 prevent damage to a delicate surface when the device is clamped to such a surface.

While the invention has been particularly shown and described with reference to an embodiment thereof, it will be understood by those skilled in the art that various changes in form and detail may be made without departing from the spirit and scope of the invention.

I claim:

1. A lighted adjustable mirror consisting of:

a frame;

a first mirror surface and a second mirror surface;

said first mirror surface and said second mirror surface are housed within said frame and face opposing directions;

a bracket;

said bracket has two ends and a middle;

said bracket is in corresponding shape with said frame;

said frame is pivitolly attached to each of the two said ends of said bracket;

a first light and a second light;

said first light is attached to said frame and faces the same direction as said first mirror surface;

said second light is attached to said frame and faces the same direction as said second mirror surface;

a switch;

said switch is attached to said frame and controls said first light and said second light;

a flexible column;

said flexible column has a first tip and a second tip;

said first tip of said flexible column is pivitolly attached to said middle of said bracket;

a clamp;

said clamp is a spring-loaded clothespin type clamp; and said second tip of said flexible column is attached to said clamp.

2. The device as in claim 1 wherein said first light and said second light are battery powered.

3. The device as in claim 1 to further include a first rubber pad and a second rubber pad; and said first rubber pad and said second rubber pad are attached to the inner surfaces of the jaws of said clamp.

4. The device as in claim 2 wherein the magnification of the first mirror surface is different from the magnification of the second mirror surface.

* * * * *